US012540452B2

(12) United States Patent
Armas

(10) Patent No.: US 12,540,452 B2
(45) Date of Patent: Feb. 3, 2026

(54) METHOD OF CONTROLLING A GRADING ATTACHMENT ON A SKID STEER VEHICLE

(71) Applicant: David Armas, Homestead, FL (US)

(72) Inventor: David Armas, Homestead, FL (US)

( * ) Notice: Subject to any disclaimer, the term of this patent is extended or adjusted under 35 U.S.C. 154(b) by 280 days.

(21) Appl. No.: 18/104,636

(22) Filed: Feb. 1, 2023

(65) Prior Publication Data

US 2023/0243122 A1 Aug. 3, 2023

Related U.S. Application Data

(60) Provisional application No. 63/305,318, filed on Feb. 1, 2022.

(51) Int. Cl.
*E02F 3/84* (2006.01)
*E02F 3/76* (2006.01)

(52) U.S. Cl.
CPC ..... *E02F 3/847* (2013.01); *E02F 3/7613* (2013.01); *E02F 3/7618* (2013.01)

(58) Field of Classification Search
CPC ..... E02F 3/847; E02F 3/7613; E02F 3/7618
See application file for complete search history.

(56) References Cited

U.S. PATENT DOCUMENTS 9,938,687 B1 4/2018 Eckrote
2004/0079541 A1* 4/2004 Marquardt ..... E02F 3/764 172/817
2010/0095559 A1* 4/2010 Buckner ..... E02F 3/8825 37/304
2010/0212193 A1* 8/2010 Kostyak ..... A01B 35/08 37/405
2016/0230367 A1 8/2016 Hendron et al.
2020/0392695 A1* 12/2020 Stocks ..... E02F 9/264
2021/0123207 A1* 4/2021 Vandegrift ..... E02F 9/2012
2023/0102419 A1* 3/2023 Graham ..... E02F 9/2246 172/1
2023/0134217 A1* 5/2023 Graham ..... E02F 3/3627 701/50
2023/0374750 A1* 11/2023 Schamberger ..... E02F 9/265
2023/0383497 A1* 11/2023 Graham ..... E02F 3/7613
2024/0068205 A1* 2/2024 Walczynski ..... E02F 3/847
2024/0254720 A1* 8/2024 Rehkemper ..... E02F 3/34

FOREIGN PATENT DOCUMENTS

CN 113684878 11/2021

* cited by examiner

*Primary Examiner* — Peter D Nolan
*Assistant Examiner* — Mikko Okechukwu Obioha
(74) *Attorney, Agent, or Firm* — Mark C. Johnson; Johnson Dalal

(57) ABSTRACT

A method of controlling a grading attachment on a skid steer vehicle that includes the steps of lowering a main arm of a skid steer vehicle with either an electric non-hydraulic cylinder or a drive motor to the main arm's lowest allowed position along an arm translation path on the skid steer vehicle and adjusting, while the main arm is the in the lowest allowed position, either or both a pitch axis movement and/or a yaw axis movement of a grading attachment coupled to the main arm autonomously using an automatic grade control system implementing at least one of a laser, a GPS, an LPS, and an ultrasonic sensor and with at least one a plurality of electric non-hydraulic cylinders and drive motors, wherein the automatic grade control system is communicatively coupled to the at least one a plurality of electric non-hydraulic cylinders and drive motors.

19 Claims, 5 Drawing Sheets

METHOD OF CONTROLLING A GRADING ATTACHMENT ON A SKID STEER VEHICLE

FIELD OF THE INVENTION

The present invention relates generally to earth moving equipment, and more particularly, to an improved method of controlling a grading attachment on a skid steer vehicle using electric cylinders and/or drive motors.

BACKGROUND OF THE INVENTION

Skid steer vehicles are commonly and commercially available. The skid steer vehicle that is preferred to work with the present invention is a small to medium size skid steer vehicle that is designed to accept any of a variety of grading attachments or front-end accessories, such as a dozer blade, pallet forks, a mower, a hole digger and several others. These front-end accessories can be interchanged relatively easy with one or two men in a few minutes. The popularity of the small to medium sized skid steer class of vehicle is owed largely to the availability of the front-end accessories by allowing a single vehicle to accomplish a wide variety of tasks without the need for specialty vehicles.

Over the last few years, large construction manufacturers have started to produce fully electric machines which use electric cylinders and drive motors for movement instead of the traditional hydraulic valves and cylinders for these skid steer vehicles. Traditional hydraulic valves and cylinders, however, are characterized by several operational drawbacks. When conducting a grading job with a traditional machine and grading attachment using hydraulic valves and cylinders, if a hose were to get pinched or burst (which happens quite often), a large amount of hydraulic oil would leak out and pollute the jobsite. Hydraulic oil contains toxic chemicals which are harmful to humans and the environment. When conducting a grading job with a machine and grading attachment both using electric cylinders, on the other hand, that environmental and health hazard would be eliminated, i.e., reduced or eliminated hydraulic repairs or leaks. Another advantage of using electric cylinders and drive motors instead of hydraulic cylinders is that it reduces the delay between a command signal being sent by the automatic grade control system and a movement occurring on the grading attachment. In other words, it allows the automatic grade control system to control the grading attachment with greater precision. Overall, using electric cylinders instead of hydraulic cylinders provides many advantages in the areas of safety, precision, ease of repair, durability, etc.

Therefore, a need exists to overcome the problems with the prior art as discussed above.

SUMMARY OF THE INVENTION

The invention provides a method of controlling a grading attachment on a skid steer vehicle that overcomes the hereinafore-mentioned disadvantages of the heretofore-known devices and methods of this general type and that provides a method of grading with a skid steer and grading attachment, both using electric cylinders and/or drive motors instead of hydraulic cylinders.

With the foregoing and other objects in view, there is provided, in accordance with the invention, a method of controlling a grading attachment on a skid steer vehicle that includes lowering a main arm of a skid steer vehicle with one or more electric non-hydraulic cylinder(s) and drive motor(s) to its lowest allowed position along an arm translation path and adjusting, while in the lowest allowed position, either or both the pitch axis movement and/or the yaw axis movement of a grading attachment coupled to the main arm autonomously using an automatic grade control system implementing at least one of a laser, a GPS, an LPS, and an ultrasonic sensor and with one or more electric non-hydraulic cylinder(s) and drive motor(s), wherein the automatic grade control system is communicatively coupled to the electric non-hydraulic cylinder(s) and drive motor(s).

In accordance with another feature, an embodiment of the present invention includes locking the main arm of the skid steer vehicle when at its lowest allowed position along the arm translation path and locking the main arm of the skid steer vehicle with the at least one of the electric non-hydraulic cylinder and the drive motor.

In accordance with yet another feature, an embodiment of the present invention also includes electrically disconnecting the at least one of the electric non-hydraulic cylinder and the drive motor when reaching the lowest allowed position along the arm translation path.

In accordance with a further feature, an embodiment of the present invention also includes lowering the main arm of the skid steer vehicle until reaching a stop component coupled to a stationary frame structure of the skid steer body.

In accordance with yet another feature, an embodiment of the present invention also includes locking the main arm of the skid steer vehicle with at least one fastener.

In accordance with an additional feature, an embodiment of the present invention also includes lowering the main arm of the skid steer vehicle until reaching a stop component coupled to a stationary frame structure of the skid steer body.

In accordance with a further feature, an embodiment of the present invention also includes at least one of an electric non-hydraulic cylinder and a drive motor operably configured to adjust the pitch axis movement and with a portion coupled to the main arm and another portion coupled to a frame element rotatably coupled to the main arm, the frame element coupled to the grading attachment and two of at least one of an electric non-hydraulic cylinder and a drive motor operably configured to adjust the yaw axis movement and each with a portion coupled to the frame element and another portion coupled to a rotatably coupled to the grading attachment.

In accordance with yet another feature, an embodiment of the present invention also includes a secondary frame element coupled to the main arm and the grading attachment and disposed underneath the two of at least one of an electric non-hydraulic cylinder and a drive motor operably configured to adjust the yaw axis movement.

In accordance with a further feature of the present invention, the secondary frame element is non-rotatably coupled to the grading attachment.

In accordance with an exemplary feature, an embodiment of the present invention also includes providing at least one of an electric non-hydraulic cylinder and a drive motor operably configured to adjust the pitch axis movement and with a portion coupled to the main arm and another portion coupled to a frame element rotatably coupled to the main arm, wherein the frame element is coupled to the grading attachment and providing two of at least one of an electric non-hydraulic cylinder and a drive motor operably configured to adjust the yaw axis movement and each with a portion coupled to the frame element and another portion rotatably coupled to the grading attachment.

Additionally, the present invention discloses a method of controlling a grading attachment on a skid steer vehicle that includes providing a skid steer vehicle with a main arm rotatably coupled a stationary frame structure of the skid steer body with at least one of an arm electric non-hydraulic cylinder and an arm drive motor and coupled to a grading attachment with at least one of a pitch arm electric non-hydraulic cylinder and a pitch drive motor operably configured to adjust a pitch axis movement of the grading attachment independent of movement of the main arm, wherein the at least one of the pitch electric non-hydraulic cylinder and the pitch drive motor with a portion coupled to the main arm and another portion coupled to a frame element rotatably coupled to the main arm, lowering the main arm with the at least one of the arm electric non-hydraulic cylinder and the arm drive motor to its lowest allowed position along an arm translation path, and adjusting, while in the main arm is maintained in its lowest allowed position and with the at least one of the pitch arm electric non-hydraulic cylinder and the pitch drive motor, the pitch axis movement of the grading attachment autonomously using an automatic grade control system implementing at least one of a laser, a GPS, an LPS, and an ultrasonic sensor, wherein the automatic grade control system is communicatively coupled to the at least one of the arm electric non-hydraulic cylinder and the at least one of the pitch arm electric non-hydraulic cylinder and the pitch drive motor.

Also in accordance with the present invention, a method of controlling a grading attachment on a skid steer vehicle is disclosed that includes providing a skid steer vehicle with a main arm rotatably coupled a stationary frame structure of the skid steer body with at least one of an arm electric non-hydraulic cylinder and an arm drive motor and coupled to a grading attachment with at least one of a pitch arm electric non-hydraulic cylinder and a pitch drive motor operably configured to adjust a pitch axis movement of the grading attachment independent of movement of the main arm, wherein the at least one of the pitch electric non-hydraulic cylinder and the pitch drive motor with a portion coupled to the main arm and another portion coupled to a frame element rotatably coupled to the main arm and adjusting, while in the grading attachment is fixed at a pitch angle with the at least one of the pitch electric non-hydraulic cylinder and the pitch drive motor and the frame element, a lift axis movement of the grading attachment autonomously using an automatic grade control system implementing at least one of a laser, a GPS, an LPS, and an ultrasonic sensor and with the at least one of an arm electric non-hydraulic cylinder and an arm drive motor, wherein the automatic grade control system is communicatively coupled to the at least one of an arm electric non-hydraulic cylinder and an arm drive motor and the at least one of an arm electric non-hydraulic cylinder and an arm drive motor.

Although the invention is illustrated and described herein as embodied in a method of controlling a grading attachment on a skid steer vehicle, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the main arm.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION OF THE INVENTION

The present invention provides a novel and efficient method of grading with a skid steer and grading attachment, both using electric cylinders and/or drive motors instead of hydraulic cylinders, that overcomes the heretofore-mentioned disadvantages of the heretofore-known devices and methods of this general type.

Figure 1:
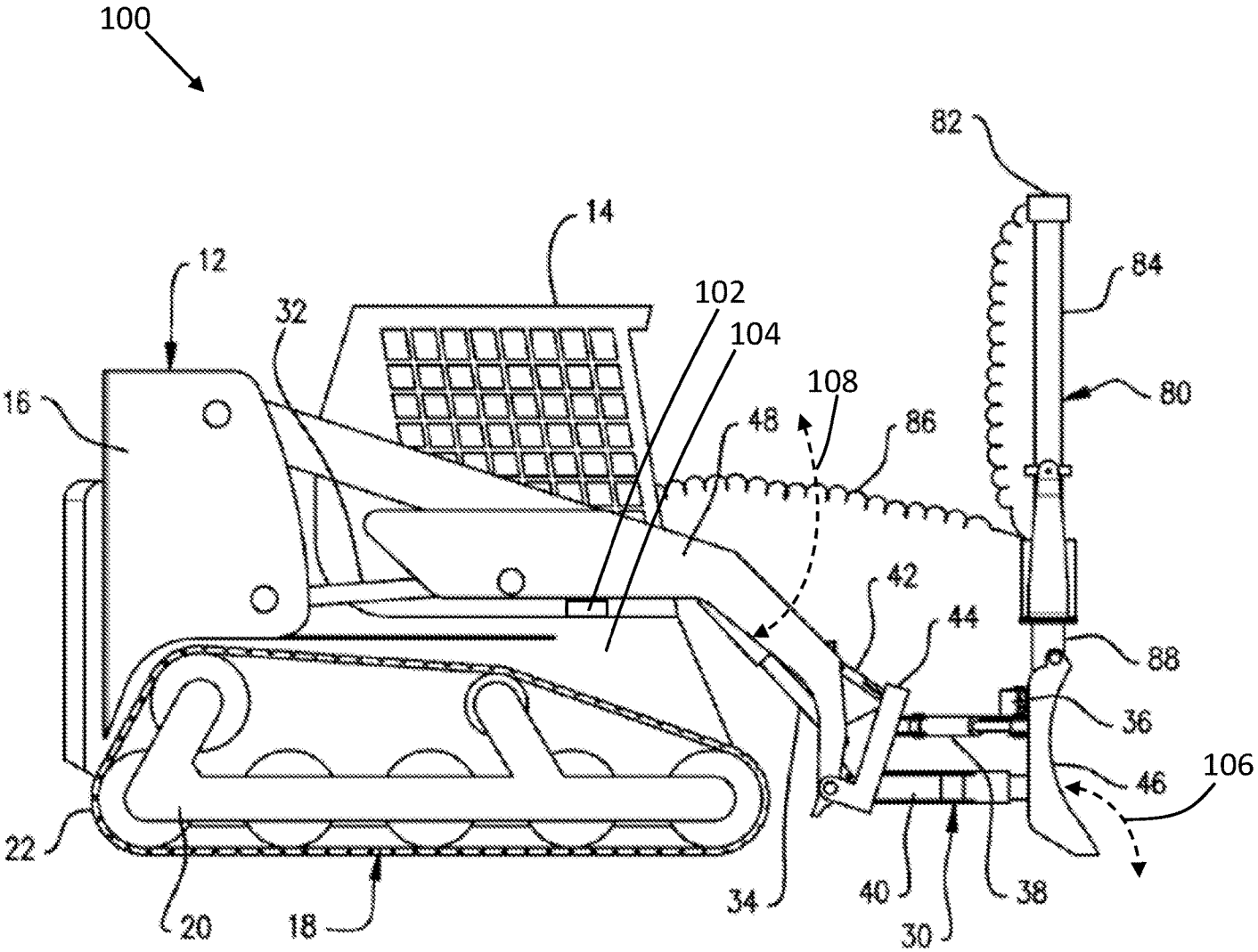
FIG. 1 is a side elevation view of a track steer vehicle, in accordance with an exemplary embodiment of the present invention.
Figure 2:
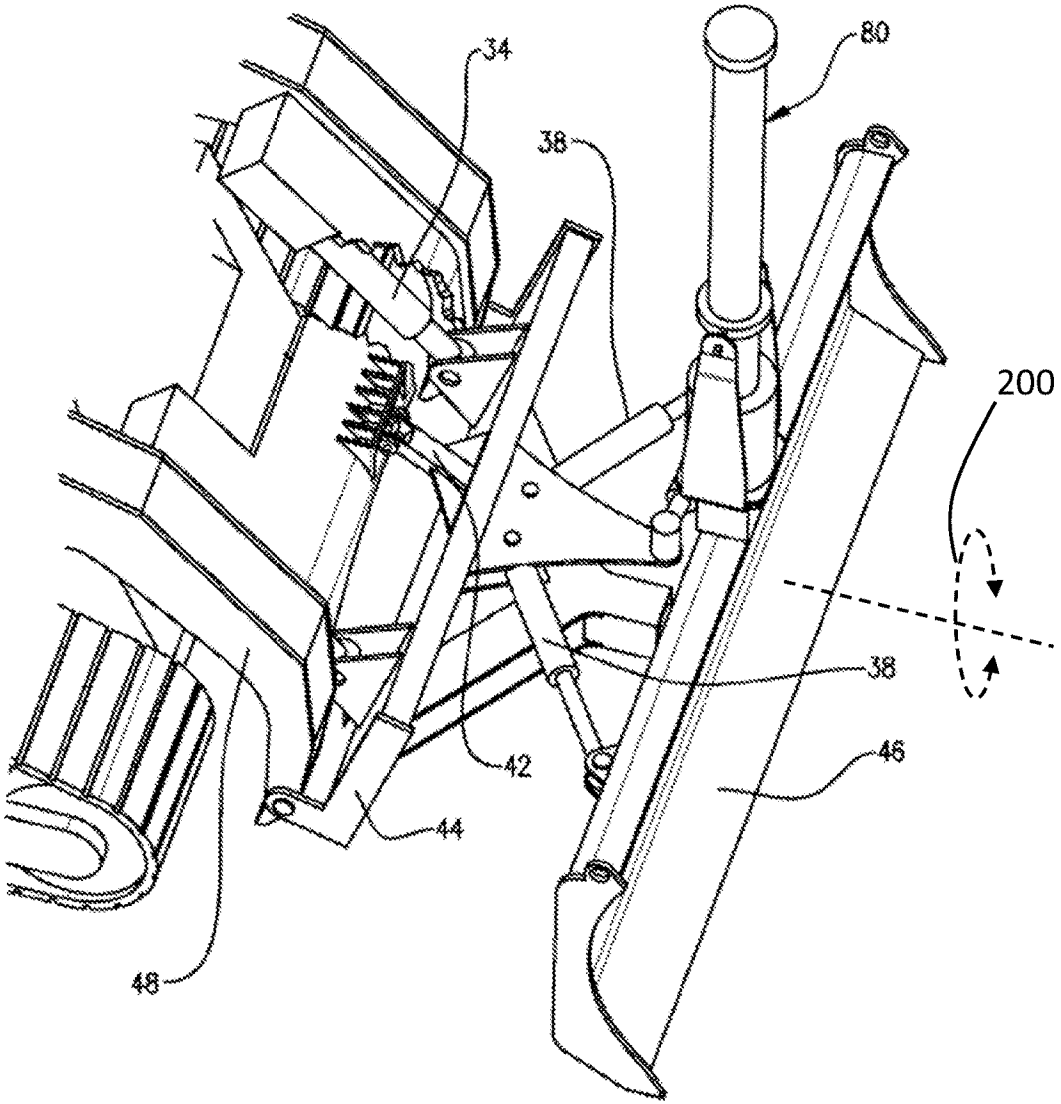
FIG. 2 is a partial perspective view of an automatic grade control system with a partial cut away, in accordance with an exemplary embodiment of the present invention.
Figure 3:
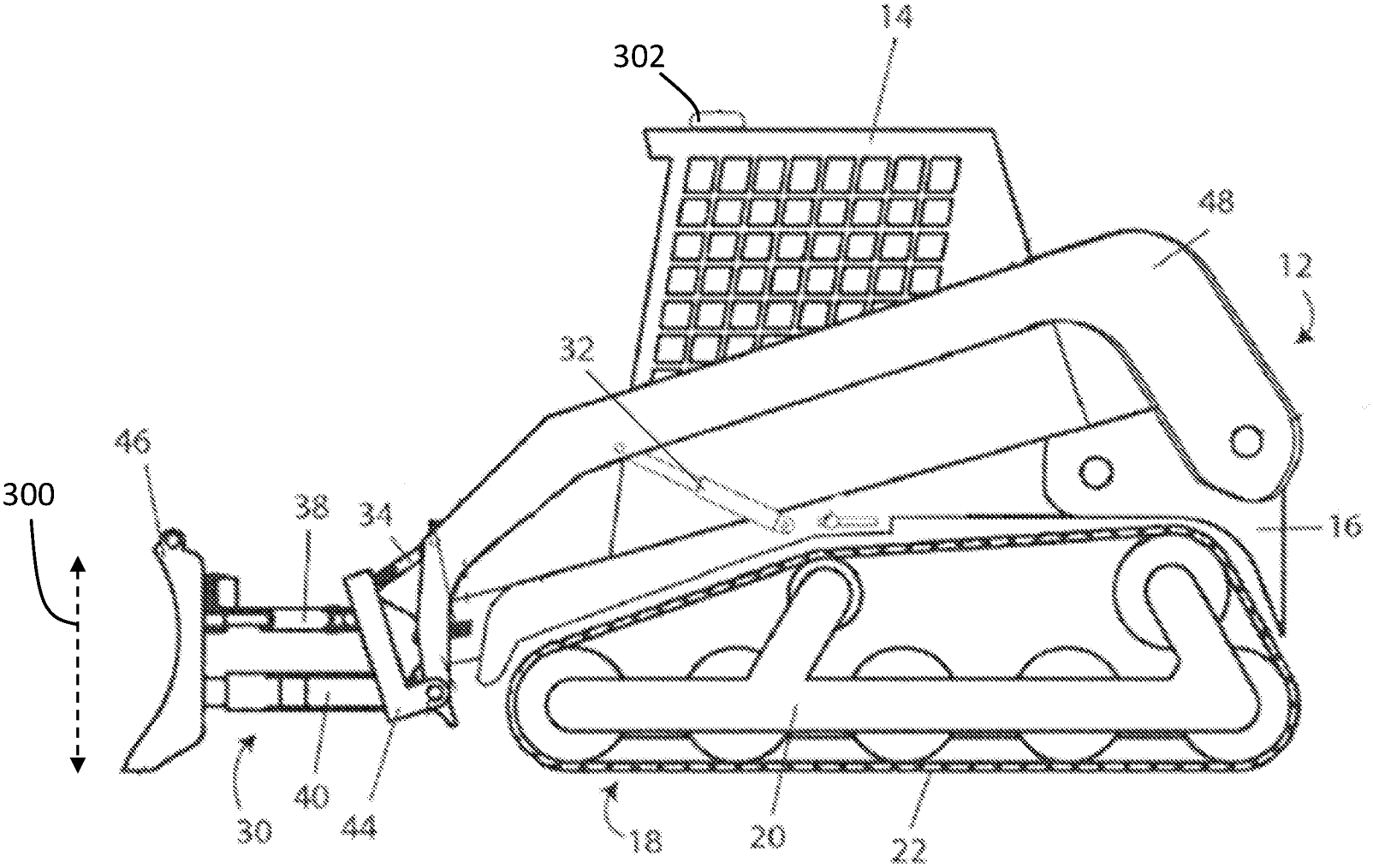
FIG. 3 is a side elevation view of a track steer vehicle with an automatic grade control system in a lowered position, in accordance with the present invention.
Figure 4:
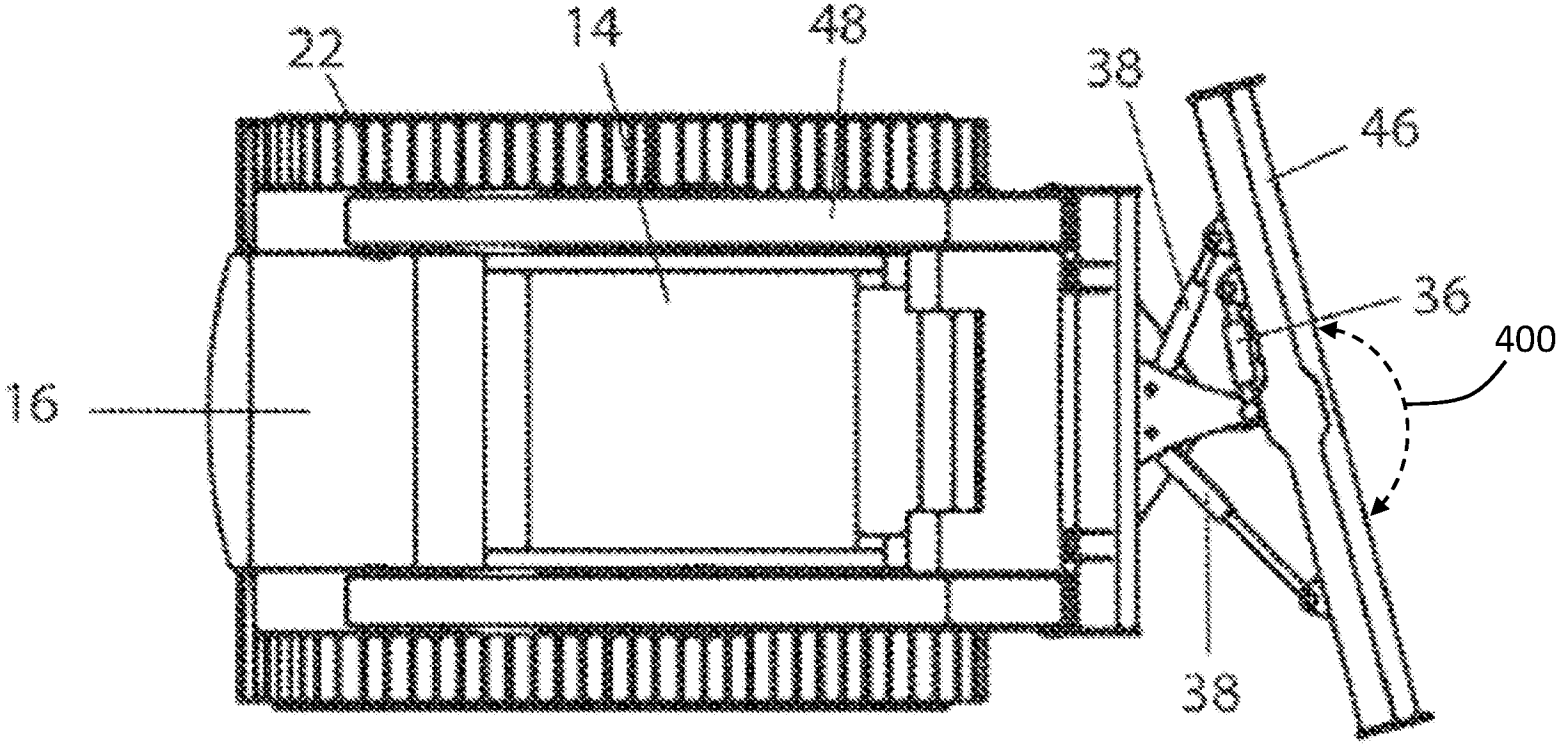
FIG. 4 is a top plan view demonstrating grading attachment yaw left, in accordance with the present invention.
Figure 5:
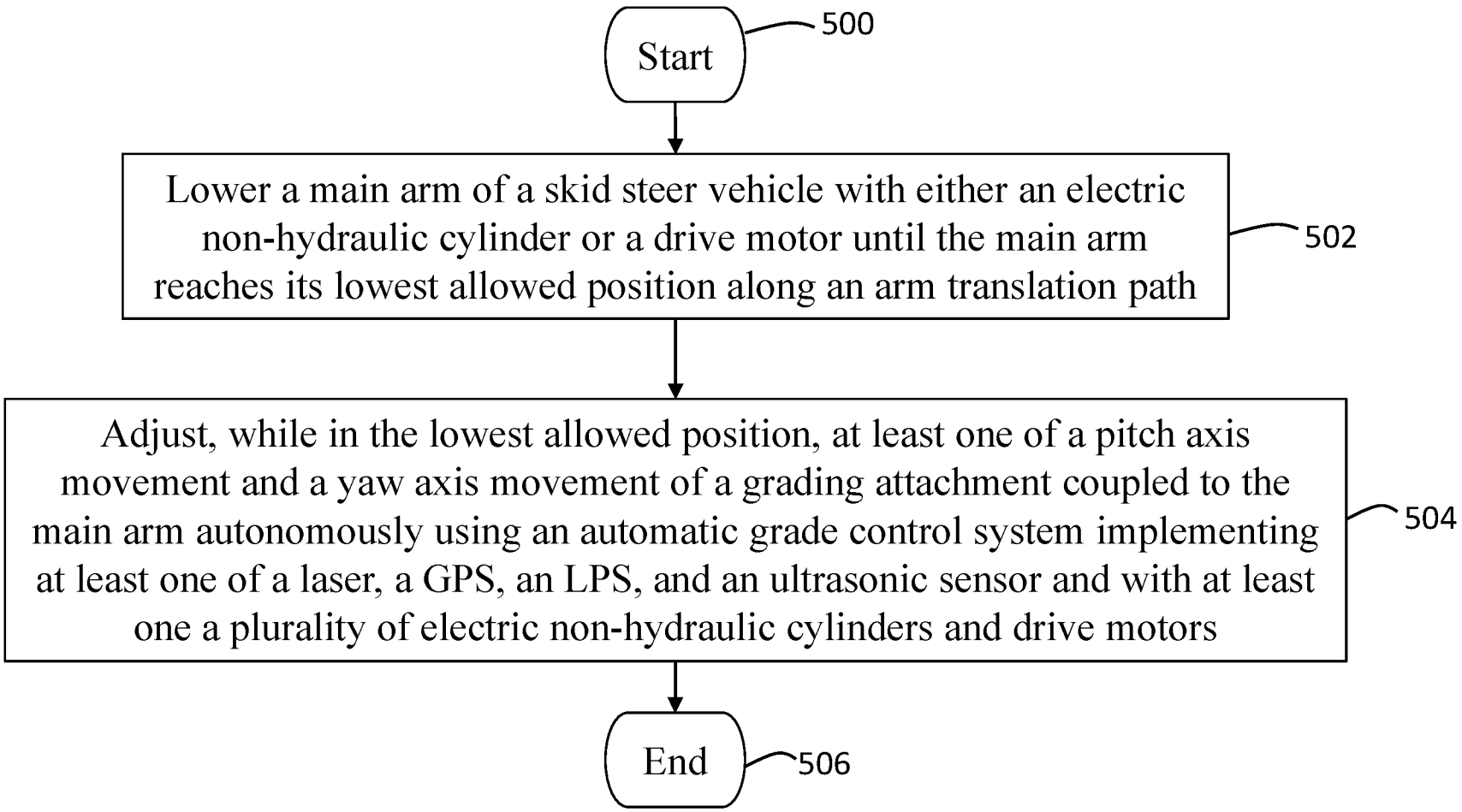
FIG. 5 is a process flow diagram depicting an exemplary method of grading with a skid steer vehicle and grading attachment in accordance with one embodiment of the present invention.

The present invention provides a method of controlling a grading attachment, particularly one controlled by an automatic grade control system, on a skid steer vehicle. Embodiments of the invention provide a method that is operably configured to grade with a skid steer and grading attachment, both using electric cylinders and/or drive motors instead of hydraulic cylinders. To that end, FIG. 1-4 will be described in conjunction with the process flow chart of FIG. 5. Although FIG. 5 shows a specific order of executing the process steps, the order of executing the steps may be changed relative to the order shown in certain embodiments. Also, two or more blocks shown in succession may be executed concurrently or with partial concurrence in some embodiments. Certain steps may also be omitted in FIG. 5 for the sake of brevity. In some embodiments, some or all of the process steps included in FIG. 5 can be combined into a single process.

Referring now to the figures, a skid steer vehicle is generally referred to with numeral 100. The skid steer vehicle 100 may include a skid steer vehicle body 12, a skid steer vehicle track assembly 18, a grading attachment assembly 30, and a leveler assembly 80. The skid steer vehicle body 12 may include, inter alia, an operator cage 14 and a battery case 16. As those of skill in the art will appreciate, an operator of the vehicle 100 sits inside of and operates the vehicle 100 from inside the operator cage 14. A battery inside the battery case 16 typically powers the vehicle 100 including any electric cylinders and/or drive motors, i.e., a battery in the battery case is electrically coupled to the electric cylinders and/or drive motors using, for example, electrical wiring.

The track assembly 18 may include, inter alia, a suspension 20 and a track 22. In most applications, the track steer vehicle 100 will have complementary track assemblies 18 on both sides of the vehicle 100 and may also include one or more bearings, wheels, or other structures to enable the track 22 to rotate.

The grading attachment assembly 30 may include, inter alia, a plurality of electric cylinders and/or drive motors 32, 34, 36, 38, a frame 40, a bracket 42, a frame 44, an attachment 46 and a main arm 48. The leveler assembly 80 may include, inter alia, a receiver 82, a mast 84, a cable 86 and a bracket 88.

In accordance with an exemplary embodiment of the present invention, the method includes affixing one or more brackets with a first end to an automatic grade control system and at a second end to a main arm to substantially prevent movement of one or more electric cylinders and/or drive motors between said automatic grade control system and said main arm that are capable of causing a pitch axis movement (represented by arrow 106 in FIG. 1) of said automatic grade control system, thereby substantially controlling said pitch axis movement 106 with said automatic grade control system 302 and said grading attachment 46, while not affecting any other electric cylinders and/or drive motors that may affect a roll axis movement (represented by arrow 200 in FIG. 2) or a yaw axis movement (represented by arrow 400 in FIG. 4) of said automatic grade control system. The electric cylinders and/or drive motors for controlling lift axis movement (represented by arrow 300 in FIG. 3) are disposed on the skid steer body 12 or on the grading attachment assembly 30. The grading attachment 30 is preferably controlled by any automatic grade control system (exemplified with number 302 in FIG. 3), which covers all grade control types (e.g., laser, GPS (global positioning system), LPS (local positioning system), ultrasonic sensor, etc.).

The method may include the steps of providing a skid steer vehicle 100 with the main arm 48, a plurality of electric cylinders and/or drive motors for controlling lift axis movement 300 that are disposed on the skid steer vehicle body 12 and/or on the grading attachment 30, and an automatic grade control system operably coupled to the electric cylinders and/or drive motors, wherein the automatic grade control system includes a frame, a grading attachment 46 having a ground contacting lower edge and a plurality of electric cylinders and/or drive motors disposed between and coupled to the frame and the grading attachment 46. The assembly 100 may also include electric cylinders and/or drive motors operably configured to control pitch axis movement 102, yaw axis movement 400, and roll axis movement 200, independently, by actuating movement of the grading attachment 46. The process may also include coupling at least one bracket having a forward end and a rearward end to the frame on the forward end, and on the main arm on the rearward end, thereby restricting movement of the pitch axis electric cylinders and/or drive motors, thereby allowing unrestricted movement of the yaw axis electric cylinders and/or drive motors, roll axis electric cylinders and/or drive motors and the lift axis electric cylinders and/or drive motors. The process may also include setting the grading attachment 46 in a desired configuration for grading and mounting the automatic grade control system to the grading attachment 46.

One of ordinary skill in the art will also appreciate a skid steer vehicle is also operably configured to have a plurality of grading attachments or assemblies attached thereto. Then providing a stop connected to the skid steer vehicle 100 upon which a point of the main arm rests thereby defining a lower limit of movement of the main arm 48. Essentially the main arm 48 bottoms out at a preset height that is complimentary of the proper height that the grading attachment 46 needs to be for its auto grading purposes. A bracket may be used to rest the main arm against or in some skid steer vehicles the body of the machine is at the appropriate height. A bracket and stop combination can be used to adapt any machine to bottom out at the right height for the pitch of the attachment alone to control the continuous auto grading. Also, positioning the point of the main arm against the stop so it is bottomed out. Also, preventing the ability of the main arm 48 from providing any lifting force by restricting the ability of an electric cylinder and/or drive motor that lifts the main arm 48. This essentially neuters the ability of the main arm to move up under power of the electric cylinder and/or drive motor that could normally otherwise lift the main arm. Also, the aforementioned vehicle assembly 100 and method provide an assembly that operably connects the automatic grade control system to an electric cylinder and/or drive motor that controls a pitch axis of movement of the grading attachment to affect a height of the grading attachment relative to a ground surface. The pitch axis of movement 102 of the attachment 46 is used to raise and lower the grade height as controlled by the automatic grading computer system. The method may further include locking the main arm 48 against the stop when the main arm 48 is at the lower limit of movement. This can be by bracket, bolt, welding, pins, chains, clamp, or other positive means to hold the main arm 48 in place at its lowest allowed (mechanically) position as determined by the stop. The method may further include operating a valve to isolate (disconnect) the electric cylinder and/or drive motor that lifts the main arm 48 to further prevent any movement of the main arm. This essentially disconnects the main arm control from the system. This can also be achieved by disconnecting and capping off the control for the main arm or by removing that control completely.

In accordance with another embodiment, the method comprises providing a skid steer vehicle having a main arm 48 with a front side operably coupled to an automatic grade control system, a stop connected to the skid steer vehicle upon which a point of the main arm rests thereby defining a lower limit of movement of the main arm 48, positioning the point of the main arm against the stop, preventing the ability of the main arm 48 from providing any lifting force by restricting the ability of a drive motor that lifts the main arm, and operably connecting the automatic grade control system to a drive motor that controls a pitch axis of movement of the grading attachment to affect a height of the grading attachment relative to a ground surface.

Still referring to FIGS. 1-4 in combination with the process flow diagram depicted in FIG. 5, the method of controlling a grading attachment on a skid steer vehicle can be seen beginning at step 500 and immediately proceeding to step 502 of lowering a main arm 48 of a skid steer vehicle 100 with either an electric non-hydraulic cylinder or a drive motor 32 until the main arm 48 reaches its lowest allowed position along an arm translation path (e.g., see exemplary path represented by arrow 108). The electric non-hydraulic cylinder or a drive motor 32 may be referred to as the "arm" electric non-hydraulic cylinder or the "arm" drive motor 32 and may include both circular and linear paths of motion.

In one embodiment, the main arm 48 of the skid steer vehicle 100 is lowered until it physically reaches, directly contacts, or otherwise reaches a stop component 102 coupled to a stationary frame structure 104 of the skid steer body 12. The cylinder/motor 32 may have one portion physically coupled to the main arm 48 and another portion physically coupled to a stationary frame portion 102 that does not move using any cylinder(s)/motor(s). The main arm 48 may be locked or maintained in the lowest allowed position with at least one fastener. The stop component 102 may be coupled to the stationary frame structure 104 of the skid steer body 12 and may be a substantially resilient, yet deformable or elastic material, such as natural rubber that can dampen any vibration and reduce noise.

The process may also be described as providing a skid steer vehicle 100 with a main arm 48 rotatably coupled a stationary frame structure 104 of the skid steer body 12 with at least one of an arm electric non-hydraulic cylinder and an arm drive motor 32. The main arm 48 is also coupled to a grading attachment 46 with at least one of a pitch arm electric non-hydraulic cylinder and a pitch drive motor 42 operably configured to adjust a pitch axis movement 106 of the grading attachment 46 independent of movement of the main arm 48. The at least one of the pitch electric non-hydraulic cylinder and the pitch drive motor 42 with a portion coupled to the main arm 48 and another portion coupled to a frame element 44 rotatably coupled to the main arm 48. The frame element 44 may be formed as a tubular substantially rigid structure or plate-like structure.

Next, the process may proceed to step 504 of adjusting (i.e., moving or physically manipulating or modulating), while in the lowest allowed position, either or both a pitch axis movement 106 and a yaw axis movement 400 of a grading attachment 46. The grading attachment 46 may be independently rotatably coupled to the main arm 48 autonomously using an automatic grade control system 302 implementing at least one of a laser, a GPS, an LPS, and an ultrasonic sensor and with at least one a plurality of electric non-hydraulic cylinders and drive motors 34, 36, 38. Said another way, the automatic grade control system 302 may be configured to detect the level of the ground surface proximal to the lower edge of the grading attachment 46 and may utilize an electronic controller, as part of the automatic grade control system 302, that is communicatively coupled to the plurality of electric non-hydraulic cylinders and drive motors 32, 34, 36, 38 (i.e., configured to emit a signal, wirelessly or through a wired connection, to the plurality of electric non-hydraulic cylinders and drive motors 32, 34, 36, 38 to extend or retract, independent of one another.

In one embodiment, the main arm 48 of the skid steer vehicle 100 is locked when at its lowest allowed position along the arm translation path using, for example, with the one or more electric non-hydraulic cylinder(s)/drive motor(s) 32. To effectuate the same, the method may include electrically disconnecting the one or more electric non-hydraulic cylinder(s)/drive motor(s) 32 when the main arm 48 reaches the lowest allowed position along the arm translation path.

The method may also include providing at least one of an electric "pitch" non-hydraulic cylinder and a "pitch" drive motor 34 operably configured to adjust the pitch axis movement and with a portion coupled to the main arm 48 and another portion coupled to a frame element 44 rotatably coupled to the main arm 48, wherein the frame element 44 is coupled to the grading attachment 46. Additionally, the method may include providing the steer vehicle 100 with two of either a "yaw" electric non-hydraulic cylinder and a "yaw" drive motor 38 operably configured to adjust the yaw axis movement 400 and each with a portion coupled to the frame element 44 and another portion coupled to a rotatably coupled to the grading attachment 46.

The method may also include providing the skid steer vehicle 100 with a secondary frame element 40 coupled to the main arm 48 and the grading attachment 46 and that is disposed underneath the yaw electric non-hydraulic cylinder(s) and yaw drive motor(s) 38. In one embodiment, the secondary frame element 40 is non-rotatably coupled to the grading attachment 46, as depicted in the figures. The process may terminate at step 506.

In another embodiment of the present invention, the vehicle 100 is configured to and does adjust the lift axis movement 300 of the grading attachment 46, while in the grading attachment 46 is fixed at a desired pitch angle with the at least one of the pitch electric non-hydraulic cylinder and the pitch drive motor 34 and the frame element 44, autonomously using an automatic grade control system 302 (as discussed above, e.g., implementing at least one of a laser, a GPS, an LPS, and an ultrasonic sensor) and with the at least one of an arm electric non-hydraulic cylinder and an arm drive motor 32.

What is claimed is:

1. A method of controlling a grading attachment on a skid steer vehicle comprising the steps of:

lowering a main arm of a skid steer vehicle with at least one of an electric non-hydraulic cylinder and a drive motor to its lowest allowed position along an arm translation path; and adjusting, while the main arm is in the lowest allowed position and while grading in the skid steer vehicle, at least one of a pitch axis movement and a roll axis movement of a grading attachment coupled to the main arm autonomously using an automatic grade control system with at least one a plurality of electric non-hydraulic cylinders and drive motors, the automatic grade control system communicatively coupled to the at least one a plurality of electric non-hydraulic cylinders and drive motors.

2. The method according to claim 1, further comprising:

locking the main arm of the skid steer vehicle when at its lowest allowed position along the arm translation path.

3. The method according to claim 2, further comprising:

locking the main arm of the skid steer vehicle with the at least one of the electric non-hydraulic cylinder and the drive motor.

4. The method according to claim 2, further comprising:

locking the main arm of the skid steer vehicle with at least one fastener.

5. The method according to claim 3, further comprising:

electrically disconnecting the at least one of the electric non-hydraulic cylinder and the drive motor when reaching the lowest allowed position along the arm translation path.

6. The method according to claim 5, further comprising:

lowering the main arm of the skid steer vehicle until reaching a stop component coupled to a stationary frame structure of the skid steer body.

7. The method according to claim 2, further comprising:

locking the main arm of the skid steer vehicle with at least one fastener.

8. The method according to claim 7, further comprising:

lowering the main arm of the skid steer vehicle until reaching a stop component coupled to a stationary frame structure of the skid steer body.

9. The method according to claim 8, further comprising:

at least one of an electric non-hydraulic cylinder and a drive motor operably configured to adjust the pitch axis movement and with a portion coupled to the main arm and another portion coupled to a frame element rotatably coupled to the main arm, the frame element coupled to the grading attachment; and two of at least one of an electric non-hydraulic cylinder and a drive motor operably configured to adjust a yaw axis movement and each with a portion coupled to the frame element and another portion coupled to a rotatably coupled to the grading attachment.

10. The method according to claim 9, further comprising:

a secondary frame element coupled to the main arm and the grading attachment and disposed underneath the two of at least one of an electric non-hydraulic cylinder and a drive motor operably configured to adjust the yaw axis movement.

11. The method according to claim 10, wherein the secondary frame element is non-rotatably coupled to the grading attachment.

12. The method according to claim 1, further comprising:

providing at least one of an electric non-hydraulic cylinder and a drive motor operably configured to adjust the pitch axis movement and with a portion coupled to the main arm and another portion coupled to a frame element rotatably coupled to the main arm, wherein the frame element is coupled to the grading attachment; and providing two of at least one of an electric non-hydraulic cylinder and a drive motor operably configured to adjust a yaw axis movement and each with a portion coupled to the frame element and another portion rotatably coupled to the grading attachment.

13. A method of controlling a grading attachment on a skid steer vehicle comprising the steps of:

providing a skid steer vehicle with a main arm rotatably coupled a stationary frame structure of the skid steer body with at least one of an arm electric non-hydraulic cylinder and an arm drive motor and coupled to a grading attachment with at least one of a pitch arm electric non-hydraulic cylinder and a pitch drive motor operably configured to adjust a pitch axis movement of the grading attachment independent of movement of the main arm, wherein the at least one of the pitch electric non-hydraulic cylinder and the pitch drive motor with a portion coupled to the main arm and another portion coupled to a frame element rotatably coupled to the main arm;

lowering the main arm with the at least one of the arm electric non-hydraulic cylinder and the arm drive motor to its lowest allowed position along an arm translation path; and adjusting, while the main arm is maintained in its lowest allowed position, while grading in the skid steer vehicle, and with the at least one of the pitch arm electric non-hydraulic cylinder and the pitch drive motor, the pitch axis movement of the grading attachment autonomously using an automatic grade control system, wherein the automatic grade control system is communicatively coupled to the at least one of the arm electric non-hydraulic cylinder and the at least one of the pitch arm electric non-hydraulic cylinder and the pitch drive motor.

14. The method according to claim 13, further comprising:

locking the main arm of the skid steer vehicle when reaching the lowest allowed position along the arm translation path.

15. The method according to claim 14, further comprising:

locking the main arm of the skid steer vehicle with the at least one of the arm electric non-hydraulic cylinder and the arm drive motor.

16. The method according to claim 15, further comprising:

electrically disconnecting the at least one of the arm electric non-hydraulic cylinder and the arm drive motor when reaching the lowest allowed position along the arm translation path.

17. The method according to claim 16, further comprising:

lowering the main arm of the skid steer vehicle until reaching a stop component coupled to the stationary frame structure of the skid steer body.

18. The method according to claim 13, further comprising:

providing two of at least one of a yaw electric non-hydraulic cylinder and a yaw drive motor operably configured to adjust a yaw axis movement of the grading attachment and each with a portion coupled to the frame element and another portion rotatably coupled to the grading attachment.

19. A method of controlling a grading attachment on a skid steer vehicle comprising the steps of:

providing a skid steer vehicle with a main arm rotatably coupled a stationary frame structure of the skid steer body with at least one of an arm electric non-hydraulic cylinder and an arm drive motor and coupled to a grading attachment with at least one of a pitch arm electric non-hydraulic cylinder and a pitch drive motor operably configured to adjust a pitch axis movement of the grading attachment independent of movement of the main arm, wherein the at least one of the pitch electric non-hydraulic cylinder and the pitch drive motor with a portion coupled to the main arm and another portion coupled to a frame element rotatably coupled to the main arm; and adjusting, while in the grading attachment is fixed at a pitch angle with the at least one of the pitch electric non-hydraulic cylinder and the pitch drive motor and while grading in the skid steer vehicle, a lift axis movement of the grading attachment autonomously using an automatic grade control system.

* * * * *